US009520101B2

(12) United States Patent
Matskewich et al.

(10) Patent No.: US 9,520,101 B2
(45) Date of Patent: Dec. 13, 2016

(54) IMAGE RENDERING FILTER CREATION

(75) Inventors: Tanya Matskewich, Redmond, WA (US); Gregory Hitchcock, Woodinville, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 584 days.

(21) Appl. No.: 13/222,240

(22) Filed: Aug. 31, 2011

(65) Prior Publication Data

US 2013/0050234 A1 Feb. 28, 2013

(51) Int. Cl.
*G09G 5/02* (2006.01)

(52) U.S. Cl.
CPC ..... *G09G 5/02* (2013.01); *G09G 2320/0666* (2013.01); *G09G 2340/0457* (2013.01); *G09G 2354/00* (2013.01); *G09G 2370/04* (2013.01)

(58) Field of Classification Search
None
See application file for complete search history.

(56) References Cited

U.S. PATENT DOCUMENTS 4,800,375 A * 1/1989 Silverstein ..... G02F 1/133514 345/694
6,188,385 B1 2/2001 Hill et al.
6,219,025 B1 4/2001 Hill et al.
6,225,973 B1 5/2001 Hill et al.
6,239,783 B1 5/2001 Hill et al.
6,243,070 B1 6/2001 Hill et al.
6,282,327 B1 8/2001 Betrisey et al.
6,307,566 B1 10/2001 Hill et al.
6,393,145 B2 5/2002 Betrisey et al.
6,421,054 B1 7/2002 Hill et al.
6,624,828 B1 9/2003 Dresevic et al.
7,106,344 B2 9/2006 D'Souza et al.
7,248,271 B2 7/2007 Credelle et al.
7,471,843 B2 12/2008 Messing et al.
7,768,537 B2 8/2010 Tognoni et al.
2003/0085906 A1* 5/2003 Elliott ..... G09G 3/20 345/613
2005/0088385 A1* 4/2005 Elliott ..... G06T 3/4007 345/87
2005/0105796 A1* 5/2005 Hong et al. ..... 382/162
(Continued)

OTHER PUBLICATIONS

Johnson, Garrett M., and Mark D. Fairchild. "A top down description of S-CIELAB and CIEDE2000." Color Research & Application 28.6 (2003): 425-435.).*

(Continued)

*Primary Examiner* — Sultana M Zalalee
(74) *Attorney, Agent, or Firm* — Sunah Lee; Dan Choi; Micky Minhas

(57) ABSTRACT

One or more techniques and/or systems are disclosed for creating an image rendering filter that can be used to produce a desired view of an image. Monitor characteristics can be identified for a monitor that is displaying the image, and viewing characteristics of a viewer intending to view the image can also be identified. The monitor characteristics and the viewing characteristics can be used to create the image rendering filter, which may be applied to the input image the monitor, resulting in an "ideal" image for the particular viewer viewing the image on the particular monitor.

20 Claims, 7 Drawing Sheets

(56) References Cited

U.S. PATENT DOCUMENTS

| | | | | |
|---|---|---|---|---|
| 2007/0206013 | A1* | 9/2007 | Brown Elliott | G09G 3/20 345/441 |
| 2008/0092086 | A1* | 4/2008 | Hamadi et al. | 715/863 |
| 2008/0316372 | A1 | 12/2008 | Xu et al. | |
| 2010/0013848 | A1* | 1/2010 | Hekstra | G09G 3/20 345/589 |
| 2010/0141141 | A1 | 6/2010 | Lee et al. | |
| 2011/0095875 | A1* | 4/2011 | Thyssen | G09G 5/10 340/407.1 |
| 2013/0147684 | A1* | 6/2013 | Lazzaro | G09G 5/005 345/1.1 |

OTHER PUBLICATIONS

P. Marziliano, F. Dufaux, S. Winkler, and T. Ebrahimi. Perceptual blur and ringing metrics: application to jpeg2000. Signal Processing: Image Communication, 19:163-172, 2004.*

Florin, et al. "An Overview about Monitors Colors Rendering", Retrieved at <<http://www.wseas.us/e-library/transactions/circuits/2010/89-191.pdf>>, WSEAS Transactions on Circuits and Systems, Issue 1, vol. 9, Jan. 2010, pp. 32-41.

Meylan, Lawrence, "High Dynamic Range Image Rendering with a Retinex-Based Adaptive Filter", Retrieved at <<http://ivrg.epfl.ch/supplementary_material/LM_adaptiveFilter/Meylan_TIP2006.pdf>>, IEEE Transactions on Image Processing, vol. 15, No. 9, Sep. 2006, pp. 2820-2830.

Catrysse, et al., "Comparative Analysis of Color Architectures for Image Sensors", Retrieved at <<http://isl.stanford.edu/groups/elgamal/abbas_publications/C069.pdf>>, Feb. 1999, pp. 26-35.

Larson, Gregory Ward, "A Proposal to Develop a High Dynamic Range Pixel Encoding", Retrieved at <<http://www.anyhere.com/gward/pixformat/proposal.html>>, Retrieved Date: May 5, 2011, pp. 7.

Platt, John C., "Optimal Filtering for Patterned Displays", Retrieved at <<http://research.microsoft.com/apps/pubs/?id=68972>>, IEEE Signal Processing Letters, vol. 7, No. 7, Jul. 2000, pp. 179-181.

"ClearType", http://research.microsoft.com/~jplatt/cleartype, Retrieved on May 11, 2011.

* cited by examiner

IMAGE RENDERING FILTER CREATION

BACKGROUND

Digital images (e.g., photos, videos, graphics, etc.) are often displayed on a monitor attached to a computing device (e.g., wired, wirelessly, integrated with). Conventionally, an image can be rasterized to a raster image comprising pixels corresponding to physical structures of the monitor upon which the image is to be displayed, and where respective pixels comprise color elements (e.g., red, green, blue (RGB)). The color elements of the pixels can comprise a display value describing how much of a particular color element is to be displayed. For example, increasing or decreasing a color element value can change the overall perceived color of the corresponding pixel (e.g., by perceptual blurring of the color elements, as perceived by humans, such as where red may be increased relative to green and blue to create burgundy, for example). Further, a filter can be applied to an input image to define the display view of the image. As an example, a filter can comprise elements corresponding to the respective pixels of the image, and the elements of the filter can further comprise values that adjust the color elements of one or more pixels up or down, thereby altering perception (e.g., color and/or resolution) of a corresponding image.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Display monitors, such as liquid crystal displays (LCDs), cathode ray tube (CRT) displays, organic light emitting diode (OLED) displays, and others, are conventionally regarded as comprising pixels. However, as provided herein, the application of image rendering filters is extended to monitors where the notion of pixel may be not well defined. That is, whereas prior image rendering filters were based upon defining RGB values of pixels, an image rendering filter as provided herein may instead be based upon defining values of color elements of a monitor. For example, as provided herein, a display monitor may be regarded as comprising repetitive patterns (e.g., areas of various geometries) of singly-colored color elements (e.g., sub-pixels). An image rendering filter as provided herein effectively defines intensities (values) of color elements in a manner such that a rendered image appears in a desired manner when displayed on a monitor. It may be appreciated that by treating the sub-pixels as separate units (e.g., detached from the notion of pixels), it may be possible to increase an effective resolution of a monitor.

Further, a viewer of a display monitor generally has particular characteristics that provide for "perceptual error" when viewing an image on the display monitor. That is, for example, a first type of viewer having a first set of viewing characteristics (e.g., normal versus distorted eye sight characteristics, human versus computer, etc.) may have different perceptual error than a second viewer having a second set of viewing characteristics. As an example, an "ideal" image (e.g., having a desired view for a particular viewer viewing on a particular monitor) may be displayed on a monitor by accounting for the monitors particular characteristics and accounting for the viewer's particular characteristics as provided herein. This same image may not be ideal, however, for a different viewer/user having different particular viewer characteristics and/or for the image displayed on a different monitor.

It may be appreciated that an "ideal" image may be regarded in the art as the image that is input for processing (e.g., prior to being filtered and/or otherwise adjusted, etc.). However, as used herein "ideal" image and/or the like does not refer to a pre-processed or an input image, but instead refers to a resulting (e.g., rendered) image after processing such that it appears or is displayed to a particular viewer viewing on a particular monitor in a desired manner (e.g., similar to the input image, but when subsequently viewed by the particular viewer viewing on the particular monitor after being rendered). It may be appreciated that an input image may or may not be obtained from the same monitor upon which the "ideal" rendered image is displayed. For example, an input image may be obtained from some other media possibly with higher resolution or different characteristics (e.g., paper, infinite-resolution image of a letter, different monitor, etc.). As provided herein, the monitor for a particular viewer. input image is reproduced in a desired (e.g., ideal) manner on a particular Previously, image rendering filters were created for text rendering on a display, where general filters were numerically calculated for particular types of monitors, and an instance of a perceptual filter was incorporated. However, such a technique used merely one sample per physical sub-pixel of a monitor and disregarded actual geometry of physical sub-pixels, thus limiting precision of the filter calculation. Further, the calculation was based on a limited number of samplings in a spatial domain, which reduces precision of the filter and leads to large numbers of calculations. Additionally, one filter type was generally applied for different types of monitors, yielding less than desired results (e.g., non-customized results).

Accordingly, one or more techniques and/or systems are disclosed where characteristics of a display monitor are accounted for, such as the geometric arrangement, for example, of color elements of one or more portions or areas of the monitor (e.g., blocks of sub-pixels), and characteristics of the viewer are accounted for to create an image rendering filter to be applied to an image. Because the image rendering filter can be calculated using the particular display characteristics of the intended monitor and the viewing characteristics of the intended viewer, when applied to the image, the resulting filtered image comprise a desired view (e.g., ideal image). For example, a geometric arrangement of color elements for the monitor, along with spectral power distributions (SPDs) (e.g., and/or components of SPDs) of the color elements can be combined with perceptual filtering/perceptual transformation of the viewer to produce the "ideal" image rendering filter (e.g., for that viewer using the monitor).

In one embodiment of creating an image rendering filter that can be used to produce a desired view of an image, one or more monitor characteristics of a monitor displaying the image are received. Further, one or more viewing characteristics for a viewer of the image are received. Additionally, the image rendering filter can be created based upon at least the received one or more monitor characteristics and the one or more viewing characteristics.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
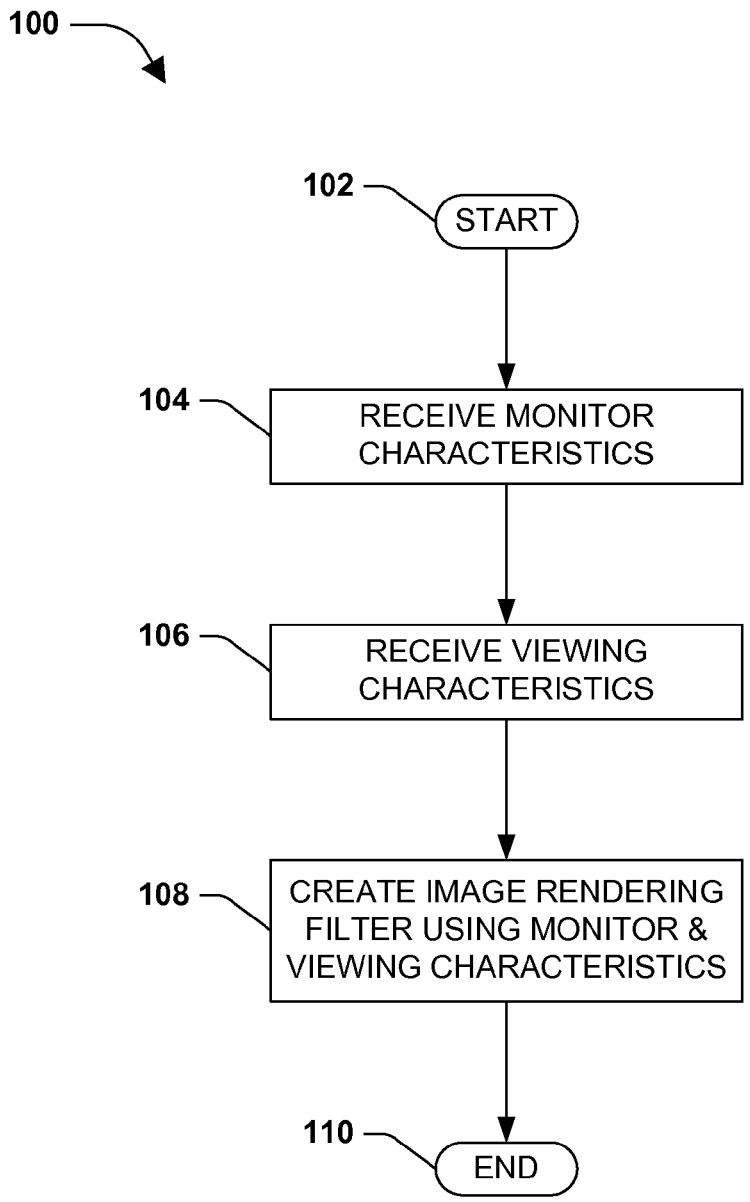
FIG. 1 is a flow diagram illustrating an exemplary method for creating an image rendering filter that can be used to produce a desired view of an image.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

As provided herein, a method may be devised that provides for finding an image rendering filter that can be applied to an image, resulting in an "ideal" image reproduced on a particular monitor for a particular viewer. That is, for example, different monitors can have different display characteristics, and different viewers can have different viewing characteristics. In this example, the particular display characteristics and the particular viewing characteristics can be accounted for when creating the image rendering filter, such that a resulting image may be an "ideal" rendering for the viewer of the image on the monitor.

FIG. 1 is a flow diagram illustrating an exemplary method 100 for creating an image rendering filter that can be used to produce a desired view of an image. The exemplary method 100 begins at 102 and involves receiving one or more monitor characteristics for a monitor that is displaying the image, at 104. At 106, one or more viewing characteristics, for a viewer that is viewing the image, are received. At 108, both the monitor characteristics and the viewing characteristics are used to create the image rendering filter, for example, which may be applied to the input image to produce the desired or ideal view of the image on the monitor for the viewer (e.g., where some skilled in the art may refer to the input image as an ideal image, but where an ideal image and/or the like as used herein instead refers to the processed or output image).

Having created the image rendering filter, the exemplary method 100 ends at 110.

It may be appreciated that a monitor can comprise a plurality of color elements or sub-pixels. A color element may represent a color component (e.g., red, green, blue (RGB)), and respective color elements can have a different level of intensity (e.g., how brightly the color is displayed), which can affect how an image may be perceived by a viewer. For example, a first sub-pixel or color element may be predominantly responsible for displaying the color red, a second sub-pixel or color element may be predominantly responsible for displaying the color blue and a third sub-pixel or color element may be predominantly responsible for displaying the color green. Further, different types of monitors can have different geometric arrangements of color elements, for example, where a group of color elements may not be easily defined as a "pixel," and may thus instead be regarded as a block or group of sub-pixels to describe a corresponding area of a monitor. Additionally, respective sub-pixels comprise spectral power distributions (SPD) (e.g., and/or components of SPDs), which describe, among other things, color characteristics, properties, etc. for the respective sub-pixels (e.g., how much light or power is emitted by respective sub-pixels at different color wavelengths). It may be appreciated that sub-pixel and/or the like as used herein may generally be regarded as one or more color elements.

As an illustrative example, an image rendering filter for producing an image on a monitor can be expressed in terms of geometric functions of a basic set of color elements of the monitor (e.g., where respective spectral power distributions (SPDs), or components thereof, for different color elements may be expressed in terms of perceptual opponent channels) and a generalized perceptual transformation (e.g., that can take into account a viewer's perceptual blurring in the opponent channels). For example, a monitor related image rendering filter may be created for a particular monitor that accounts for the monitors color element arrangement, where SPDs (e.g., and/or components of SPDs) of the color elements, which may be applied to an input image to produce a rendered image that may be desired for that particular monitor. However, the viewer's perception of the image may not be accounted for in this type of monitor related image rendering filter. Accordingly, as provided herein, characteristics of the viewer (e.g., human, camera, etc.) can be considered as well to create an image rendering filter that yields an "ideal" image given both the characteristics of the particular monitor and the characteristics of the particular viewer.

Figure 2:
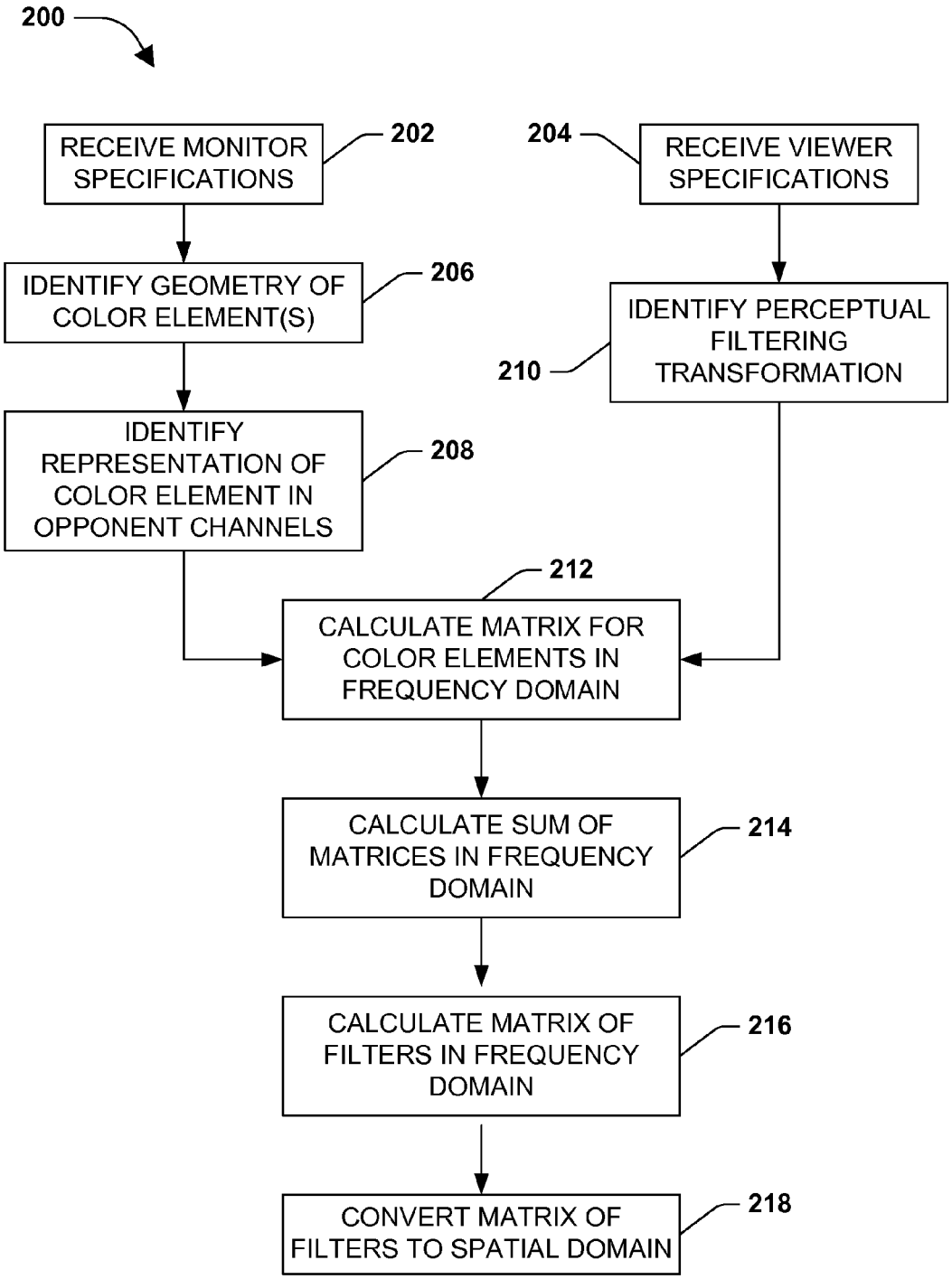
FIG. 2 is a flow diagram illustrating an example embodiment where one or more portions of one or more techniques described herein may be implemented.

FIG. 2 is a flow diagram illustrating an example embodiment 200 where one or more portions of one or more techniques described herein may be implemented. At 202, specifications and/or characteristics for a monitor on which an image will be viewed may be received. For example, the monitor may be connected (e.g., via wire, wireless, integrated) to a computing device, and the computing device can receive (e.g., pull or push) the monitor characteristics (specifications).

In one embodiment, the monitor specifications and/or characteristics can comprise color element (e.g., sub-pixel) characteristics and/or geometric characteristics of at least a portion or area of the monitor (e.g., repetitive block of color elements of the monitor, etc.). Monitor characteristics can comprise, for example, how many color elements are present per area of the monitor and/or one or more colors indicated by respective color elements. Further, the monitor characteristics can comprise how blocks of the monitor and/or color elements (e.g., sub-pixels) are arranged, for example, and/or an intensity (e.g., maximal intensity) of light emitted by respective color elements at respective spatial locations.

For example, at 206 in the example embodiment 200, a geometry, geometric characteristic, geometric arrangement, etc. of the sub-pixels (e.g., color elements) of the monitor can be identified. In one embodiment, this may describe an arrangement of the color elements in the monitor relative to one another, such as in a repetitive block of color elements and/or selected area of the monitor. For example, a cathode ray tube (CRT) monitor may comprise substantially circular sub-pixels that are arranged in a geometric pattern usually repeating every two triplets (e.g., pixels). An LCD may comprise substantially rectangular sub-pixels that are arranged in a geometric pattern usually repeating every triplet (e.g., pixel). Other monitors can comprise arrangements where the sub-pixels are aligned in a hexagon pattern, a diagonal pattern, and/or where the sub-pixels comprise different shapes (e.g., circles, squares, etc.) and/or arrangements (e.g., relative to one another).

At 208, one or more portions or components of spectral power distributions (SPDs) for one or more color elements of the monitor can be identified from the monitor characteristics. In one embodiment, a representation of a color element in opponent channels can, for example, be an identified component of an SPD for a color element. An opponent channel may be regarded as being related to a color opponent process of the human visual system. Humans (e.g., and some other animals) perceive color using cones in the retina, which respond to different ranges of wavelengths of light that overlap each other. In the color opponent process there are three opponent channels: red versus green, blue versus yellow, and black versus white (or luminance).

As an example, different monitors may provide different SPD values for their color elements, which can be determined from respective monitor characteristics. An SPD for a sub-pixel or color element of a monitor can thus have one or more components, where an SPD component may, for example, be described as an intensity or amount of illumination that is provided at a particular wavelength of light (color) (e.g., how bright red may be). For example, SPD components of an incandescent light bulb often comprise higher wavelength values in the red and yellow wavelength ranges, whereas fluorescent light bulbs often have higher wavelength values in the blue and green wavelength ranges. Further, in this example, various types of monitors may have different SPD values (e.g., and/or values for SPD components) for respective color elements (e.g., depending on type of material used, light source, power source, etc.).

In one aspect, the geometric arrangement of the color elements and/or the SPD component values of the color elements in the opponent channels can affect how colors are perceived by a viewer. As an example, neighboring color element colors typically appear as a single color due to optic blurring and spatial integration because the color elements are close to one another and relatively small as compared to the viewing distance (e.g., distance from the viewer to the color elements). Further, as an example, the intensity of a particular wavelength of light may alter a perceived color produced by neighboring color elements (e.g., having a brighter yellow sub-pixel may change a perception of a neighboring red sub-pixel from red to orange). Therefore, in this aspect, for example, how respective color elements are arranged relative to one another and/or how intense a particular color may be displayed can alter the perceived color of (at least a portion of) an image, as well as a sharpness and/or contrast of (at least a portion of) the image, for example.

At 204 in the example embodiment 200, one or more viewer specifications and/or characteristics (e.g., comprising specific user/viewer specifications, formulations, etc., such as user input weighting factors, for example), can be received, such as at a computing device connected to the monitor. At 210, generalized perceptual filtering (transformation) of opponent channels for the viewer can be identified from the viewer specifications. As an example, the viewer may comprise a human viewer of the image, where different humans can comprise different viewing characteristics. For example, a near-sighted person may see an image differently than a person with normal eyesight, and a person with a type of color-blindness may see colors differently than one with normal vision. Further, as an example, the viewer may comprise a computing device using an image detection component (e.g., camera). In this example, a first camera may comprise different viewing characteristics than a second camera.

In one embodiment, the viewing characteristics can comprise one or more perceptual filtering or transformation parameters. Perceptual filtering or transformation parameters can comprise a perceptual blurring parameter of one or more visual opponent channels for the viewer (e.g., how different wavelengths of light are affected (e.g., blurred by) by a visual system of a particular user, a weighting parameter (e.g., showing relative importance of errors in different opponent channels and/or relative importance of different kinds of errors for a particular viewer) and/or a contrast parameter of one or more of the visual opponent channels for the viewer (e.g., how contrast related parameters affect a particular user's viewing experience). For example, as described above, the human visual system typically blends colors of neighboring color elements (e.g., or sub-pixels) into a single color by a visual blurring effect and luminance resolution of the respective color element colors, and such phenomena can be accounted for or at least considered by the perceptual filtering parameters.

In this embodiment, for example, a perceptual blurring parameter for the visual opponent channels may be associated with a particular type of viewer, such as a first perceptual blurring parameter for a human viewer with normal eyesight, a second parameter for a human viewer that is color blind, and a third parameter for a particular type of camera system. Further, a weighting parameter for one or more types of perceptual errors may be associated with a particular type of viewer, and/or a contrast parameter may be associated with a particular type of viewer.

As an example, a database of viewers may be maintained, and, depending on the viewer type and characteristics, a set of perceptual filtering parameters may be associated with respective viewer types in the database. As another example, the viewer may input viewing characteristics into the computing device (e.g., responding to specific questions), and appropriate perceptual filtering or transformation parameters can be assigned to the viewer. For example, a viewer may give a response of green when shown blue (or vice versa), thus allowing the viewer to be identified as potentially having some degree of blue/green color blindness.

In one embodiment, one or more characteristics related to one or more filtered image goals may also be received and used to help determine the image rendering filter. As an example, a viewer may identify different image viewing tasks based on relative importance of an error in different opponent channels, relative important of contrast errors, etc., for example. In this embodiment, the characteristics of the filtered image goal can comprise, or rather be comprised within viewer specifications or characteristics obtained at 204, for example (e.g., where viewer/user provided weighting parameters, for example, that may assist the viewer in achieving particular viewing goals). By way of example, one or more perceptual filtering transformation parameters that may be comprised within viewing characteristics obtained at 204 may comprise a perceptual blurring parameter of one or more visual opponent channels for the viewer, a contrast parameter of one or more of the visual opponent channels for the viewer, and/or one or more parameters related to a perceptual transformation goal (e.g., weighting parameters of one or more components of the perceptual transformation), etc.

At 212 in the example embodiment 200, a matrix in frequency domain can be calculated for a group (e.g., block) of color elements, which can be used in generating an image rendering filter. It may be appreciated that such a matrix is for the color elements of the block together, and expresses a generalized correlation or relation between characteristics of different color elements. The matrix is thus calculated for a group of color elements rather than color elements individually. By way of example, a Hermitian square matrix that can represent a generalized correlation value for respective pairs of color elements of a block/area of a monitor can be calculated. As an example, a geometry function ($\mathcal{M}^{\pi}$) and one or more components ($Z^{\pi,i}$) of the SPD in opponent channels (i), for respective color elements ($\pi$), can be determined, and a corresponding function ($\mathcal{M}_f^{\pi}$) can be calculated in a frequency domain (f) for the respective color elements. Further, in this example, the perceptual filtering or transformation ($\mathcal{N}^i$) for respective opponent channels can be determined and a corresponding function ($\mathcal{N}_f^i$) can be calculated in frequency domain. Additionally, in this example, a generalized correlation matrix ($\mathcal{L}_f$) can be calculated for the given frequency ($\xi$) as a result of a matrix multiplication:

$$\mathcal{L}_f(\xi)=\overline{\mathcal{M}}_f Z \overline{\mathcal{N}_f}_f \mathcal{N}_f Z^T \mathcal{M}_f(\xi).$$

At 214, a periodic generalized correlation matrix can be calculated as a sum of respective matrices in frequency domain. As an example, a matrix sum $\hat{\mathcal{L}}(\xi)=\Sigma_k \mathcal{L}_f(\xi+k/\Lambda)$ can be calculated, where $\hat{\mathcal{L}}$ may be periodic with period $1/\Lambda$, $\Lambda$ being size of the block/area in spatial domain. Further, in this example, although $\hat{\mathcal{L}}(\xi)$ may involve an infinite summation, the summation terms include $|\mathcal{N}_f|^2$, which can decrease extremely fast, and the terms, effectively becomes zero after a low number of iterations K, such as three to five iterations. Therefore, in this example, the summation matrix for the respective frequencies may be calculated as:

$$\hat{\mathcal{L}}(\xi) \approx \sum_{k=-K}^{K} \mathcal{L}_f\left(\xi+\frac{k}{\Lambda}\right).$$

At 216 in the example, embodiment 200, a rendering filter matrix may be determined for respective frequencies. As an example, at a given frequency ($\xi$) a matrix of filters ($\Phi_f^{opp}(\xi)$) can be calculated by solving a linear system with system matrix being size of number of color elements in a block: $\hat{\mathcal{L}}$ $\overline{\Phi_f^{opp}}=\overline{\mathcal{M}}_f Z \overline{\mathcal{N}_f}\ \mathcal{N}$. At 218, the matrix of filters can be converted to a spatial domain. In one embodiment, converting the matrix of filters to the spatial domain can comprise applying an inverse Fourier transform to the respective filters of the filter matrix. As an illustrative example, respective elements of the filter matrix can determine a contribution (e.g., by applying a convolution operation) of an opponent channel of an input image to intensity of one or more color elements of a corresponding block/area of the monitor.

The resulting filter matrix in the spatial domain can comprise the image rendering filter for the particular monitor and particular viewer, for example. In one embodiment, creating the image rendering filter can comprise determining a linear rendering filter for a type of monitor that is displaying the image and for a type of viewer that is viewing the image. In this way, in this embodiment, a new image rendering filter may not need to be created for each new viewer and/or monitor, for example. Instead, in this example, an image rendering filter may be selected for a viewer and monitor of the same type as used to determine the image rendering filter.

In one aspect, for example where there is limited support of geometric functions in the spatial domain, and a generalized perceptual transformation filter is a simple identity transformation, the process described above may not be used to determine the matrix of filters used for the image rendering filter, for example. In one embodiment, in this aspect, where a geometry of the respective color elements, of at least a portion of the monitor, do not intersect, the image rendering filter may be calculated directly in the spatial domain (e.g., no inverse Fourier transform is needed).

As an illustrative example, the following formula illustrates how the image rendering filter may be determined:

$$\Phi^{\pi,i}=\frac{Z^{\pi,i}}{(ZZ^T)^{\pi,\pi}L_2^2(M)}\mathcal{M}^{\pi}.$$

In this example, $\Phi^{\pi,i}$ comprises an element of the image rendering filter that describes a contribution of i-th opponent channel of an image that is input in an intensity of color element $\pi$. Further, in this example, the element of the image rendering filter can be proportional to a normalized geometry (e.g., geometric function) ($\mathcal{M}^{\pi}$) of the color element, with a coefficient of proportionality depending on components of SPDs of the color elements in opponent channels ($Z^{\pi,i}$).

In one embodiment, in this aspect, monitor characteristics can be received for the monitor, a geometry ($\mathcal{M}^{\pi}$) of the color elements can be identified and one or more component of the SPDs of the color elements in the opponent channels (Z) can also be identified. Further, in this embodiment, the matrix of the image rendering filter ($\Phi$) can then be calculated directly in the spatial domain, for example, using the above described formula.

In another aspect, a generalized perceptual transformation may become negligibly small for example, for frequencies higher than $$\frac{1}{2\Lambda},$$

where $\Lambda$ comprises a size of a block of sub-pixels in the monitor. As an example, this may reasonably be expected to occur with higher-resolution monitors, considering the perceptual blur of the human visual system. In this example, monitors may continue to increase in resolution, and may also comprise a reduced size of color elements.

In one embodiment, in this aspect, an area of the monitor may comprise color elements (e.g., three sub-pixels of a pixel of an LCD monitor) that comprise different primaries (e.g., RGB primaries). In this embodiment, describing an input image in channels of the monitor's primary colors (e.g., in standard RGB channels) may be similar to describing the input image in opponent channels. Therefore, in this embodiment, an image rendering filter (e.g., a matrix of rendering filters) that may be applied to the input image can also be described in channels of the monitors primaries. As an illustrative example, respective rendering filters of the matrix can describe a contribution of a primary channel of an input image relative to an intensity of a color element of the monitor.

For example, for a three sub-pixel per pixel LCD monitor, the filter matrix in this case may be diagonal (e.g., an input channel of a monitor primary can contribute merely to the intensity of color elements corresponding to the same primary). Further, in this example, in the frequency domain the rendering filter $\Phi_f^{\pi}$ for color-element $\pi$ can be provided by the following formula, where $\mathcal{M}_f^{\pi}$ comprises a geometry of color element $\pi$ in the frequency domain:

$$\Phi_f^{\pi}(\xi) = \begin{cases} (\overline{M_f^{\pi}}(\xi))^{-1} & \text{for } \xi \in \left[-\frac{1}{2\Lambda}; \frac{1}{2\Lambda}\right] \\ 0 & \text{otherwise.} \end{cases}$$

In one embodiment, in this aspect, the monitor characteristics can be received for the monitor on which the image will be viewed. Further, in this embodiment, for respective color elements, a geometry ($\mathcal{M}^{\pi}$) can be identified, which can be transformed into a frequency domain ($\mathcal{M}_f^{\pi}$). Additionally, for respective color elements, a rendering filter can be calculated in the frequency domain, using the above described formula, resulting in a matrix of rendering filters for at least a portion of the monitor. The matrix of filters can be converted into the spatial domain, for example, thereby providing the image rendering filter for the image on the monitor.

Figure 3:
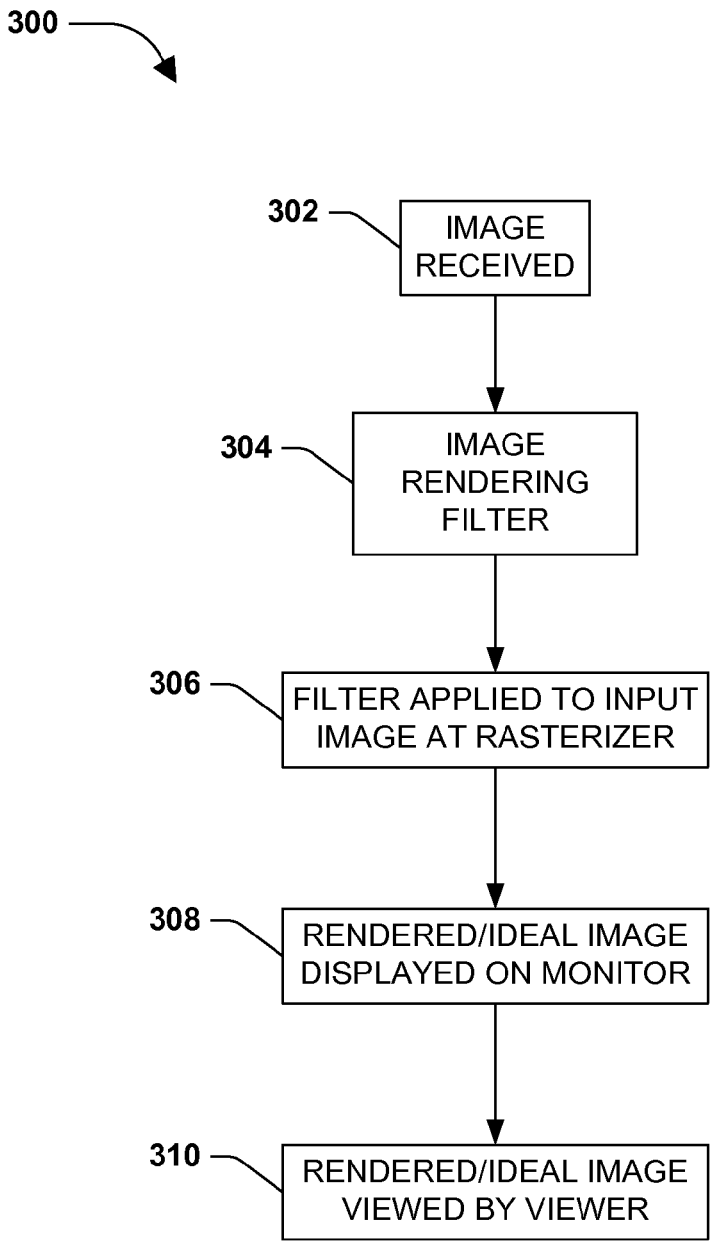
FIG. 3 is a flow diagram illustrating an example embodiment of one or more portions of one or more techniques described herein.

FIG. 3 is a flow diagram illustrating an example embodiment 300 of one or more portions of one or more techniques described herein. At 302, an image is received, such as at a computing device connected with the monitor that is going to display the image. At 304, the image rendering filter created for the particular monitor and for the intended viewer (e.g., or monitor type and viewer type) is received, such as at the computing device.

At 306, a rasterizer applies the image rendering filter to the input image. As an example, a rasterizer can convert an input image into a raster image, which comprises values of sub-pixels for display by the monitor (e.g., comprising instructions regarding respective voltages, for example, to apply to structures comprising physical sub-components/elements of the monitor). At 308, the filtered image is displayed on the monitor, as an "ideal" image (e.g., ideal for the monitor and viewer), and the "ideal" image is viewed by the viewer, at 310.

A system may be devised for creating an image rendering filter that is specific to a particular type of viewer and a particular type of monitor, for example, resulting in a filtered image that is "ideal" for the monitor and viewer. Different monitors and different viewers comprise characteristics that result in a view of an image that is less than desired (e.g., due to differing display characteristics and/or different viewing characteristics). An image rendering filter can be created that accounts for the various characteristics of the monitor and viewer, resulting in a filtered image that is ideal (e.g., comprises a desired view) for the particular type of monitor and viewer.

Figure 4:
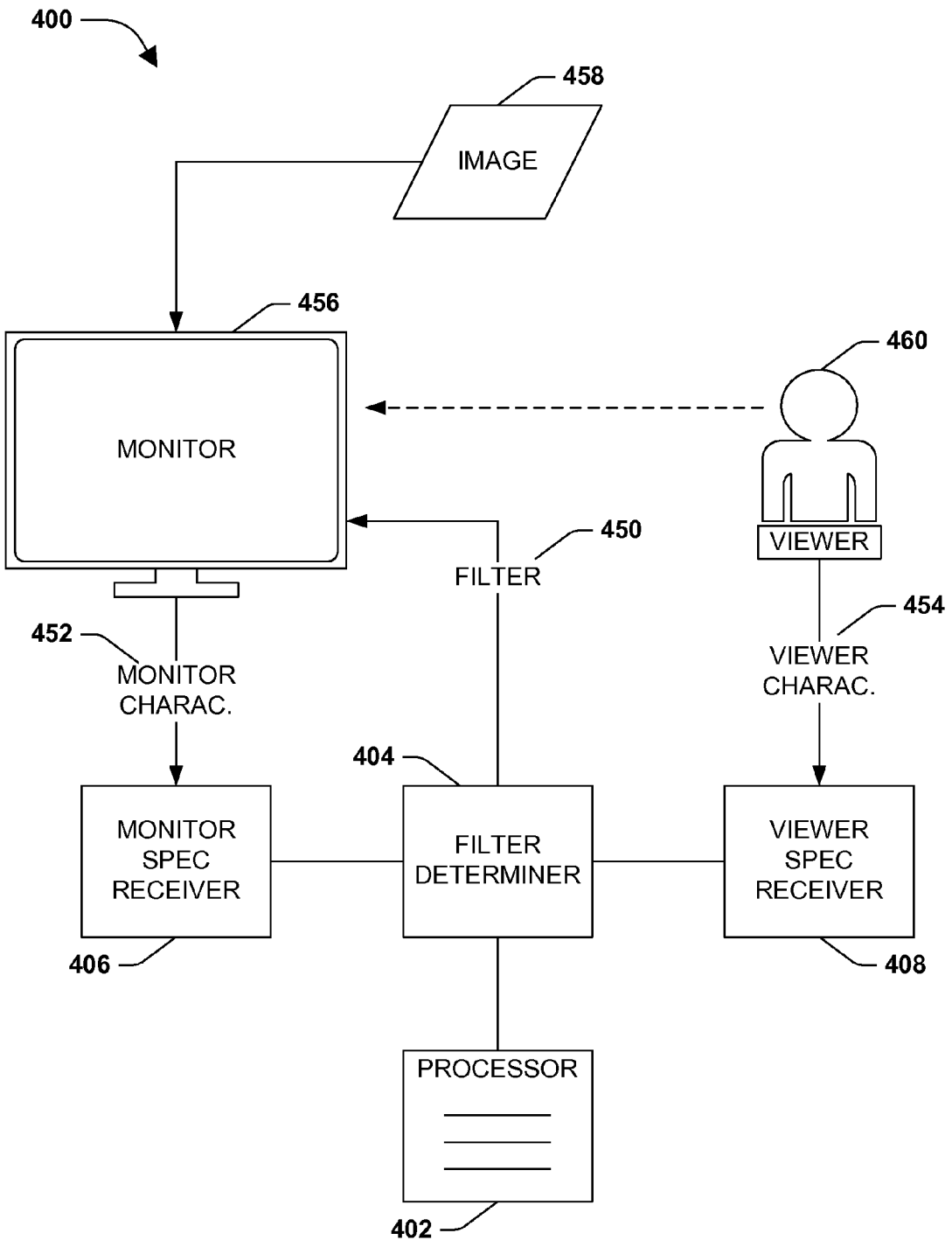
FIG. 4 is a component diagram illustrating an exemplary system for determining an image rendering filter that can be used to produce a desired view of an image.

FIG. 4 is a component diagram illustrating an exemplary system 400 for determining an image rendering filter that can be used to produce a desired view of an image. A computer-based processor 402 is configured to process data for the system 400, and the processor 402 is operably coupled with a filter determination component 404. The filter determination component 404 is configured to determine the image rendering filter 450 based at least in part upon one or more monitor characteristics 452 and one or more viewer characteristics 454. The image rendering filter 450 may be applied to the image 458, resulting in a desired view of the image 458 displayed on a monitor 456 for viewing by a viewer 460.

The exemplary system 400 further comprises a monitor specification receiving component 406, which is operably coupled with the filter determination component 404, and is configured to receive the one or more monitor characteristics 452 for the monitor 456 displaying the image 458 and provide the one or more monitor characteristics 452 to the filter determination component 404. Additionally, the exemplary system 400 comprises a viewer specification receiving component 408, which is operably coupled with the filter determination component 404, and is configured to receive the one or more viewer characteristics 454 for a viewer 460 viewing the image 458 and provide the one or more viewer characteristics 454 to the filter determination component 408.

Figure 5:
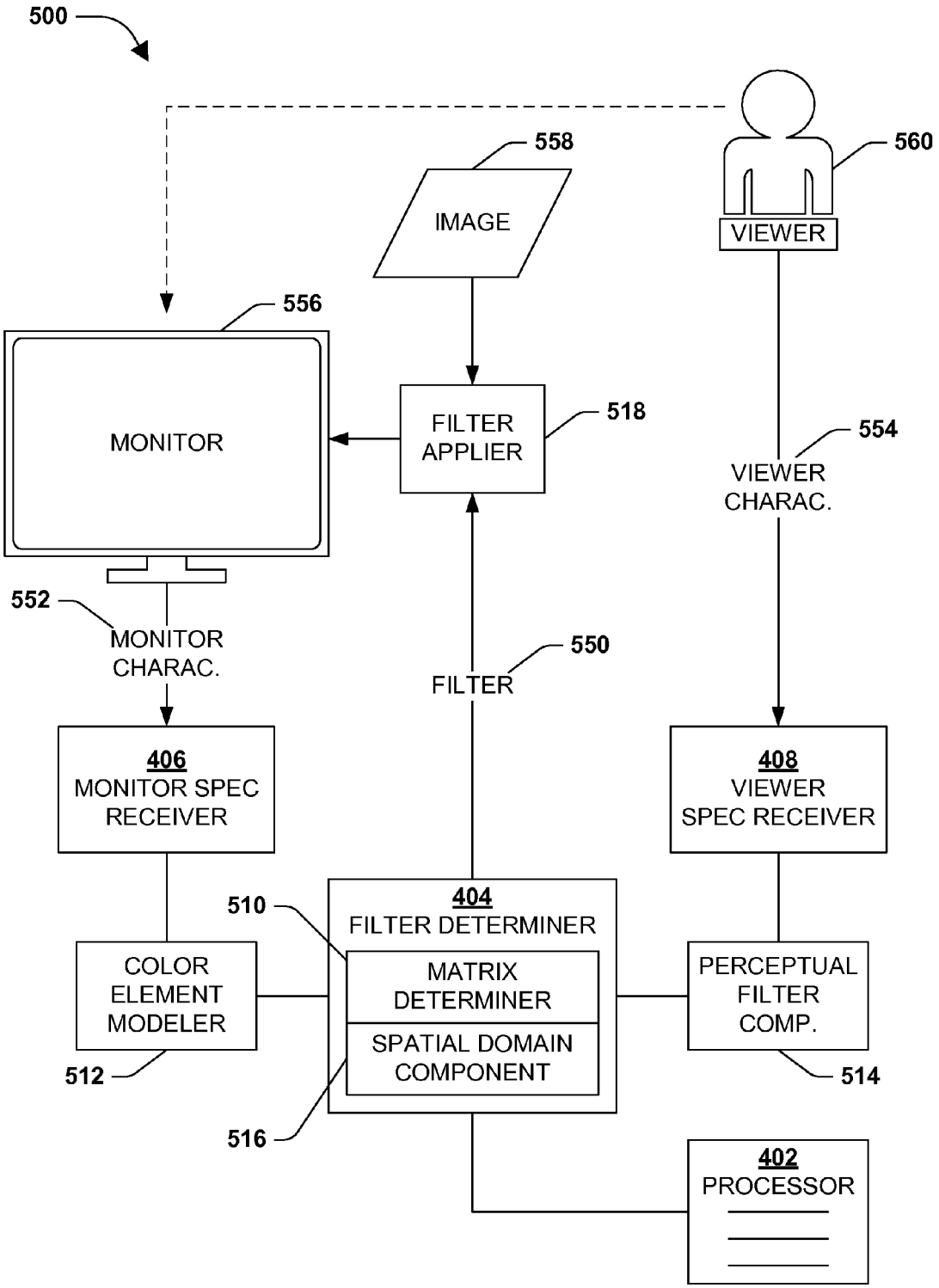
FIG. 5 is a component diagram illustrating an example embodiment where one or more systems described herein may be implemented.

FIG. 5 is a component diagram illustrating an example embodiment 500 where one or more systems described herein may be implemented. In this example 500, an extension of FIG. 4 is provided and thus description of elements, components, etc. described with respect to FIG. 4 may not be repeated for simplicity. In this example embodiment 500, the filter determination component 404 can comprise a matrix determination component 510.

The matrix determination component 510 can be configured to determine a generalized correlation matrix $\mathcal{L}_f$ in frequency domain using a geometry variable (e.g., $\mathcal{M}^{\pi}$ for respective color elements it), one or more components of spectral power distribution (SPD) variable in opponent channels (e.g., $Z^{\pi,i}$ for opponent channels i) and/or a perceptual filter variable (e.g., $\mathcal{N}^{i}$ for opponent channel i). Further, the matrix determination component 510 can be configured to determine a periodic generalized correlation matrix by summation of one or more generalized correlation matrices and/or determine a matrix of filters for respective one or more frequencies in frequency domain.

The filter determination component 404 can also comprise a spatial domain component 516 that is configured to convert the matrix of filters into a spatial domain resulting in an image rendering filter 550. In one embodiment, the spatial domain component 516 can be configured to convert the matrix of filters into a spatial domain by applying an inverse Fourier transform to the matrix of filters.

A color element modeling component 512 can be configured to determine a geometry variable for respective color elements (e.g., sub-pixels) of at least a portion of the monitor 556, based at least upon one or more received monitor characteristics 552. Further, the color element modeling component 512 can be configured to determine a representation of color elements in opponent channels, for at least a portion or area of the monitor 552, based at least upon one or more received monitor characteristics 552. This representation may be determined from one or more portions or components of SPDs of the color elements and/or based on alternative data such as RGB descriptions of color elements.

A perceptual filter component 514 can be configured to determine a perceptual filter or transformation variable for respective opponent channels of a color element, for at least a portion of the monitor, based at least upon one or more received viewer characteristics 554 for a viewer of the image 558. In one embodiment, the one or more viewer characteristics 554 can comprise one or more perceptual filtering or transformation parameters for one or more respective color elements, such as a perceptual blurring parameter of one or more visual opponent channels for the viewer, a weighting parameter of one or more components (e.g. types of errors) for the viewer and/or a contrast parameter of one or more of the visual opponent channels for the viewer.

In the example embodiment 500, a filter application component 518 may be configured to apply the image rendering filter 550 to the image 558 resulting in a desired view of the image on the monitor 556. For example, the image rendering filter can account for the particular display characteristics of the monitor 556 (e.g., monitor type) and the particular viewing characteristics of the viewer 560 (e.g., viewer type). In this example, when the filter application component 518 applies the image rendering filter 550 to the image 558, the resulting image displayed on the particular monitor 556 will comprise a desired (e.g., ideal) view for viewing by the particular viewer 560.

Figure 6:
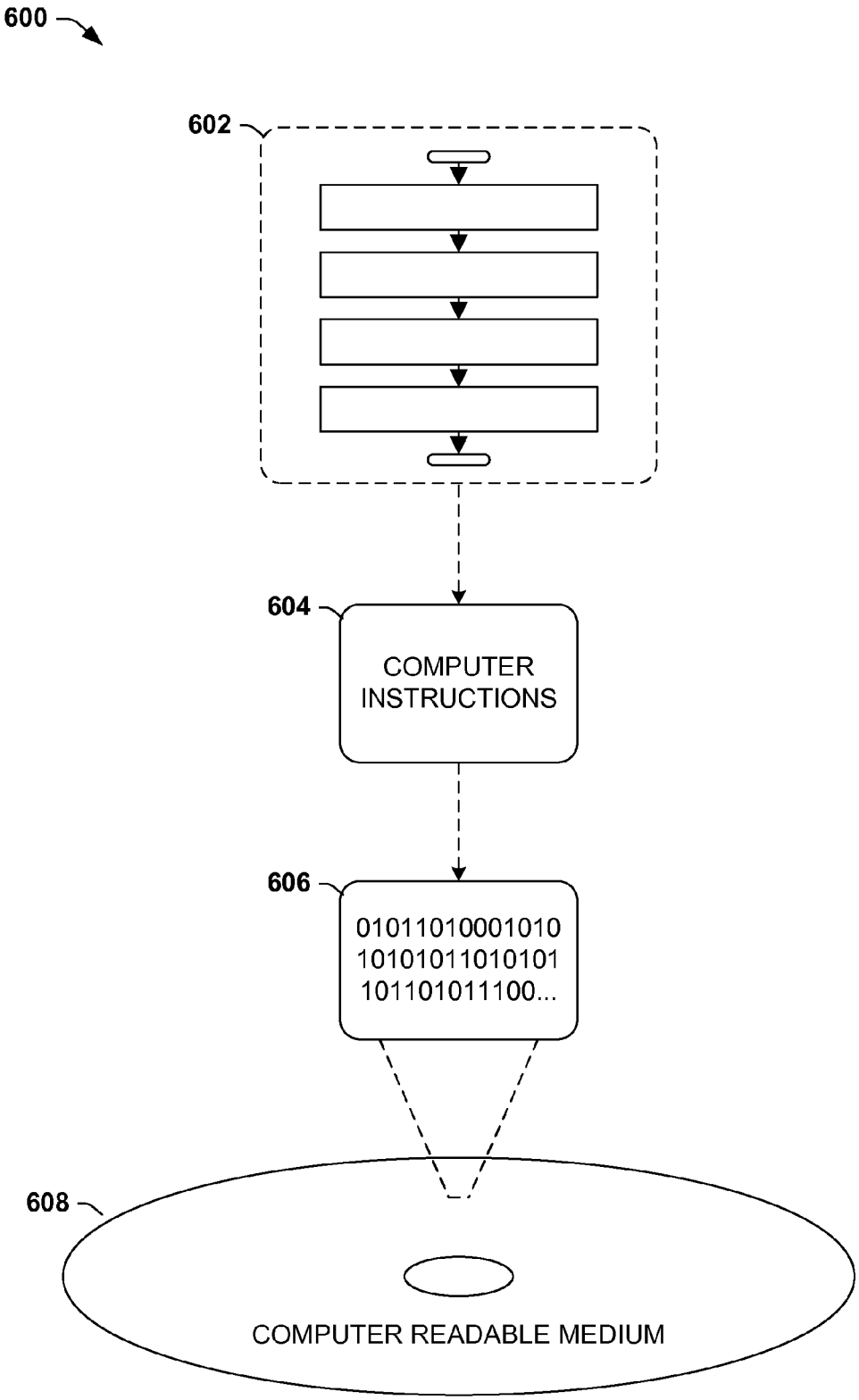
FIG. 6 is an illustration of an exemplary computer-readable medium comprising processor-executable instructions configured to embody one or more of the provisions set forth herein.

Still another embodiment involves a computer-readable medium comprising processor-executable instructions configured to implement one or more of the techniques presented herein. An exemplary computer-readable medium that may be devised in these ways is illustrated in FIG. 6, wherein the implementation 600 comprises a computer-readable medium 608 (e.g., a CD-R, DVD-R, or a platter of a hard disk drive), on which is encoded computer-readable data 606. This computer-readable data 606 in turn comprises a set of computer instructions 604 configured to operate according to one or more of the principles set forth herein. In one such embodiment 602, the processor-executable instructions 604 may be configured to perform a method, such as at least some of the exemplary method 100 of FIG. 1, for example. In another such embodiment, the processor-executable instructions 604 may be configured to implement a system, such as at least some of the exemplary system 400 of FIG. 4, for example. Many such computer-readable media may be devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used in this application, the terms "component," "module," "system", "interface", and the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, those skilled in the art will recognize many modifications may be made to this configuration without departing from the scope or spirit of the claimed subject matter.

Figure 7:
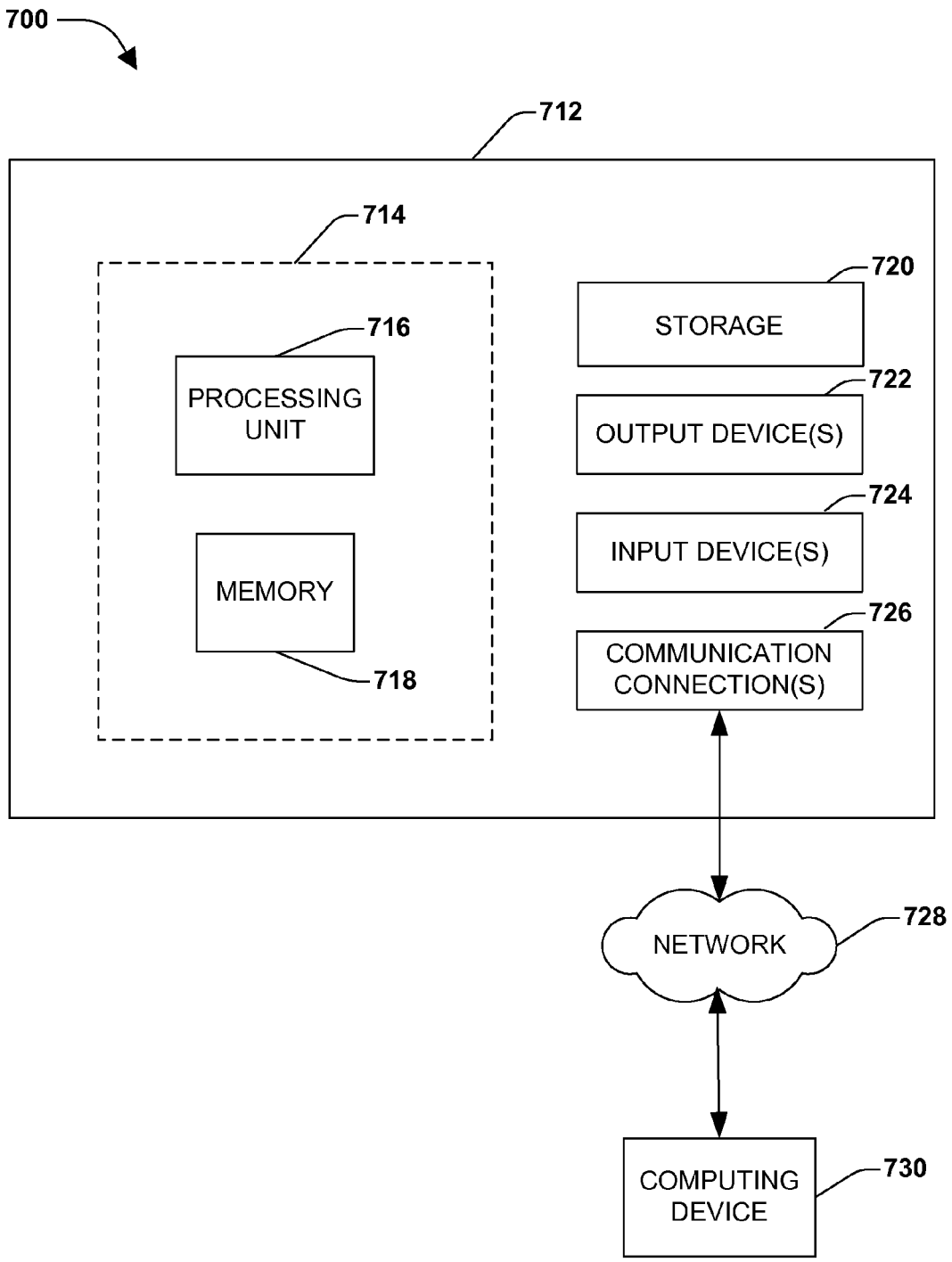
FIG. 7 illustrates an exemplary computing environment wherein one or more of the provisions set forth herein may be implemented.

FIG. 7 and the following discussion provide a brief, general description of a suitable computing environment to implement embodiments of one or more of the provisions set forth herein. The operating environment of FIG. 7 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 7 illustrates an example of a system 700 comprising a computing device 712 configured to implement one or more embodiments provided herein. In one configuration, computing device 712 includes at least one processing unit 716 and memory 718. Depending on the exact configuration and type of computing device, memory 718 may be volatile (such as RAM, for example), non-volatile (such as ROM, flash memory, etc., for example) or some combination of the two. This configuration is illustrated in FIG. 7 by dashed line 714.

In other embodiments, device 712 may include additional features and/or functionality. For example, device 712 may also include additional storage (e.g., removable and/or non-removable) including, but not limited to, magnetic storage, optical storage, and the like. Such additional storage is illustrated in FIG. 7 by storage 720. In one embodiment, computer readable instructions to implement one or more embodiments provided herein may be in storage 720. Storage 720 may also store other computer readable instructions to implement an operating system, an application program, and the like. Computer readable instructions may be loaded in memory 718 for execution by processing unit 716, for example.

The term "computer readable media" as used herein includes computer storage media. Computer storage media includes volatile and nonvolatile, removable and non-removable media implemented in any method or technology for storage of information such as computer readable instructions or other data. Memory 718 and storage 720 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 712. Any such computer storage media may be part of device 712.

Device 712 may also include communication connection(s) 726 that allows device 712 to communicate with other devices. Communication connection(s) 726 may include, but is not limited to, a modem, a Network Interface Card (NIC), an integrated network interface, a radio frequency transmitter/receiver, an infrared port, a USB connection, or other interfaces for connecting computing device 712 to other computing devices. Communication connection(s) 726 may include a wired connection or a wireless connection. Communication connection(s) 726 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 712 may include input device(s) 724 such as keyboard, mouse, pen, voice input device, touch input device, infrared cameras, video input devices, and/or any other input device. Output device(s) 722 such as one or more displays, speakers, printers, and/or any other output device may also be included in device 712. Input device(s) 724 and output device(s) 722 may be connected to device 712 via a wired connection, wireless connection, or any combination thereof. In one embodiment, an input device or an output device from another computing device may be used as input device(s) 724 or output device(s) 722 for computing device 712.

Components of computing device 712 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 712 may be interconnected by a network. For example, memory 718 may be comprised of multiple physical memory units located in different physical locations interconnected by a network.

Those skilled in the art will realize that storage devices utilized to store computer readable instructions may be distributed across a network. For example, a computing device 730 accessible via network 728 may store computer readable instructions to implement one or more embodiments provided herein. Computing device 712 may access computing device 730 and download a part or all of the computer readable instructions for execution. Alternatively, computing device 712 may download pieces of the computer readable instructions, as needed, or some instructions may be executed at computing device 712 and some at computing device 730.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein.

Moreover, the word "exemplary" is used herein to mean serving as an example, instance, or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. A computer-based method for creating an image rendering filter that can be used to produce a desired view of an image, comprising:

receiving one or more monitor characteristics of a monitor displaying the image, the one or more monitor characteristics comprising a pattern of sub-pixel color elements and colors indicated by the sub-pixel color elements;

receiving two or more viewing characteristics for a viewer of the image, the two or more viewing characteristics comprising at least two of:

a perceptual blurring parameter defined based upon how one or more wavelengths of light are blurred by the viewer;

a weighting parameter defined based upon how opponent channels of color are perceived by the viewer; or a contrast parameter defined based upon how the viewer perceives contrast between colors;

determining a filtered image goal for images displayed on the monitor to the viewer, the filtered image goal determined based upon a type of viewer to which the viewer corresponds, the filtered image goal weighting a first of the two or more viewing characteristics differently than a second of the two or more viewing characteristics; and creating the image rendering filter, using a computer-based processor, the image rendering filter being expressed as combination of a geometric function describing geometry of a group of subpixel color elements and components of spectral power distribution in opponent channels of the subpixel color elements of the group, and a perceptual filtering transform describing a perceptual filtering for the opponent channel according to the filtered image goal.

2. The method of claim 1, comprising:

receiving the image; and applying the image rendering filter to the image to produce the desired view of the image.

3. The method of claim 1, the one or more monitor characteristics comprising color element characteristics of an area of the monitor.

4. The method of claim 3, the color element characteristics of the area of the monitor comprising one or more components of spectral power distributions (SPDs) in opponent channels of a color element.

5. The method of claim 1, comprising maintaining a database specifying viewing characteristics for one or more viewers, the two or more viewing characteristics for the viewer received from the database.

6. The method of claim 1, comprising determining the two or more viewing characteristics for the viewer based upon a series of one or more questions posed to the viewer.

7. The method of claim 1, wherein the creating the image rendering filter comprises determining a linear rendering filter for a type of the monitor displaying the image.

8. The method of claim 1, wherein creating the image rendering filter comprises:

determining a first matrix representing, in a frequency domain, the geometric function and the spectral power distribution (SPD), and a second matrix representing, in the frequency domain, the perceptual filtering transform;

determine a product of the first and second matrices in the frequency domain to provide a filter matrix; and applying an inverse Fourier transform to the filter matrix.

9. A computer system for determining an image rendering filter that can be used to produce a desired view of an image, comprising:

at least one computer-based processor configured to process data;

computer readable storage device comprising computer executable instructions that when executed configure the computer-based processor to be comprising:

a monitor specification receiving component configured to receive one or more monitor characteristics for a monitor displaying the image, the one or more monitor characteristics comprising a pattern of sub-pixel color elements and colors indicated by the sub-pixel color elements;

a viewer specification receiving component configured to receive two or more viewing characteristics for a viewer viewing the image; and a filter determination component configured to:

determine a filtered image goal for images displayed on the monitor to the viewer, the filtered image goal determined based upon a type of viewer to which the viewer corresponds, the filtered image goal weighting a first of the two or more viewing characteristics differently than a second of the two or more viewing characteristics; and create the image rendering filter the image rendering filter being expressed as combination of a geometric function describing geometry of a group of subpixel color elements and components of spectral power distribution in opponent channels of the subpixel color elements of the group, and a perceptual filtering transform describing a perceptual filtering for the opponent channel according to the filtered image goal.

10. The computer system of claim 9, wherein, to create the image rendering filter, the filter determination component is further configured to:

determine a first matrix representing, in a frequency domain, the geometric function and the spectral power distribution (SPD), and a second matrix representing, in the frequency domain, the perceptual filtering transform; and determine a product of the first and second matrices in the frequency domain to provide a matrix of filters.

11. The computer system of claim 10, comprising a spatial domain component configured to convert the matrix of filters into a spatial domain resulting in the image rendering filter.

12. The computer system of claim 11, the spatial domain component configured to convert the matrix of filters into the spatial domain by applying an inverse Fourier transform to the matrix of filters.

13. The computer system of claim 9, wherein the filter determination component comprises a color element modeling component configured to:

determine the geometric function for the group of subpixel color elements of at least a portion of the monitor based at least upon the one or more monitor characteristics.

14. The computer system of claim 9, comprising a perceptual filter component configured to determine the perceptual filtering transform for respective opponent channels of the image for at least a portion of the monitor based at least upon the two or more viewing characteristics.

15. The computer system of claim 9, comprising a filter application component configured to apply the image rendering filter to the image resulting in the desired view of the image on the monitor.

16. The computer system of claim 9, the viewer specification receiving component receiving the two or more viewing characteristics from a database specifying viewing characteristics for one or more viewers.

17. A computer readable storage device comprising computer executable instructions that when executed perform a method for creating an image rendering filter that can be used to produce a desired view of an image, the method comprising:

receiving one or more monitor characteristics of a monitor displaying the image, the one or more monitor characteristics comprising a pattern of sub-pixel color elements and colors indicated by the sub-pixel color elements;

receiving two or more viewing characteristics for a viewer of the image, the two or more viewing characteristics comprising at least two of:

a perceptual blurring parameter defined based upon how one or more wavelengths of light are blurred by the viewer;

a weighting parameter defined based upon how opponent channels of color are perceived by the viewer; or a contrast parameter defined based upon how the viewer perceives contrast between colors;

determining a filtered image goal for images displayed on the monitor to the viewer, the filtered image goal determined based upon a type of viewer to which the viewer corresponds, the filtered image goal weighting a first of the two or more viewing characteristics differently than a second of the two or more viewing characteristics;

creating the image rendering filter the image rendering filter being expressed as combination of a geometric function describing geometry of a group of subpixel color elements and components of spectral power distribution in opponent channels of the subpixel color elements of the group, and a perceptual filtering transform describing a perceptual filtering for the opponent channel according to the filtered image goal; and applying the image rendering filter to the image to adjust one or more properties of the image to produce the desired view of the image.

18. The computer readable storage device of claim 17, the one or more monitor characteristics comprising color element characteristics of an area of the monitor.

19. The computer readable storage device of claim 18, the color element characteristics of the area of the monitor comprising one or more components of spectral power distributions (SPDs) in opponent channels of a color element.

20. The computer readable storage device of claim 17, wherein creating the image rendering filter comprises:

determining a first matrix representing, in a frequency domain, the geometric function and the spectral power distribution (SPD), and a second matrix representing, in the frequency domain, the perceptual filtering transform;

determine a product of the first and second matrices in the frequency domain to provide a filter matrix; and applying an inverse Fourier transform to the filter matrix.

* * * * *